United States Patent [19]

Kanasashi

[11] Patent Number: 5,020,503

[45] Date of Patent: Jun. 4, 1991

[54] AIR-FUEL RATIO CONTROL SYSTEM FOR AUTOMOTIVE ENGINES

[75] Inventor: Yusuke Kanasashi, Akishima, Japan

[73] Assignee: Fuji Jukogyo Kabushiki Kaisha, Tokyo, Japan

[21] Appl. No.: 360,366

[22] Filed: Jun. 2, 1989

[30] Foreign Application Priority Data

Jun. 21, 1988 [JP] Japan ..... 63-154469

[51] Int. Cl.[5] ..... F02M 33/02

[52] U.S. Cl. ..... 123/520; 123/519

[58] Field of Search ..... 123/520, 519, 518, 521, 123/494, 458, 357, 358, 359

[56] References Cited

U.S. PATENT DOCUMENTS

| | | | |
|---|---|---|---|
| 4,275,697 | 6/1981 | Stoltman | 123/520 |
| 4,467,769 | 8/1984 | Matsumura | 123/520 |
| 4,630,581 | 12/1986 | Shibata | 123/520 |
| 4,641,623 | 2/1987 | Hamburg | 123/520 |
| 4,646,702 | 3/1987 | Matsubara | 123/520 |
| 4,763,634 | 8/1988 | Morozumi | 123/520 |

FOREIGN PATENT DOCUMENTS

| | | | |
|---|---|---|---|
| 58-35256 | 3/1983 | Japan . | |
| 59-188063 | 10/1984 | Japan . | |
| 60-8458 | 1/1985 | Japan . | |
| 60-175757 | 9/1985 | Japan . | |
| 61-1857 | 1/1986 | Japan . | |
| 0069747 | 3/1989 | Japan | 123/519 |

*Primary Examiner*—Carl Stuart Miller

*Attorney, Agent, or Firm*—Martin A. Farber

[57] ABSTRACT

An automotive engine has a canister for purging fuel vapor to an intake passage of the engine through a purge valve. An $O_2$-sensor is provided for producing an output voltage relative to oxygen concentration of exhaust gases of the engine. A feedback control system responds to an output signal of the $O_2$-sensor for controlling the air-fuel ratio of mixture supplied to the engine with a correcting coefficient. Stopping of the purging of the fuel vapor at idling of the engine is detected and a purge cut-off signal is produced. In response to the purge cutt-off signal, the coefficient is increased to 1.0, so that the air-fuel ratio is reduced to enrich the mixture, thereby preventing the mixture from becoming lean at the stopping of the purging.

5 Claims, 7 Drawing Sheets

AIR-FUEL RATIO CONTROL SYSTEM FOR AUTOMOTIVE ENGINES

BACKGROUND OF THE INVENTION

The present invention relates to a system for controlling the air-fuel ratio of an air-fuel of mixture for an automotive engine, and more particularly to a system for controlling the air-fuel ratio in accordance with a feedback signal from an $O_2$-sensor for detecting the oxygen concentration of exhaust gases from the engine.

Generally, the engine is provided with a carbon canister for absorbing the fuel vapor in a fuel tank during the time when the engine is not running, and for purging the fuel vapor from the canister to an intake manifold at predetermined conditions of the engine operation. When the fuel in the canister is purged, the fuel vapor is added to the air-fuel mixture induced in the cylinders of the engine, rendering the mixture rich.

Referring to FIG. 6, a conventional canister purge system comprises a carbon canister 12 having a purge valve 15 and a solenoid-operated control valve 13 provided in a line 14 which communicates the purge valve 15 with an intake passage 3. The canister 12 is communicated with the intake passage 3 downstream and upstream of a throttle valve 3*a* through the purge valve 15 and a purge line 16. The control valve 13 is opened when its solenoid is energized by a signal current from an electronic control unit 20. Accordingly, vacuum communicating with the purge valve 15 through the line 14 opens the valve so that the fuel vapor trapped in the canister 12 is purged into the intake passage 3 through the purge line 16. In order to stabilize the air-fuel ratio when the engine is idling, an idle signal is applied to the control unit 20 to de-energize the solenoid of the control valve 13 to close the purge valve 15, thereby stopping the purging of the fuel vapor.

In another type of a canister purge system shown in FIG. 7, the canister 12 is communicated with a purge port 3*b* formed in a throttle body immediately above the throttle valve 3*a* through the purge line 16. When the engine is idling, the throttle valve 3*a* is closed, so that vacuum does not communicate with the canister 12, thereby cutting off the purging of the fuel vapor.

When the vehicle is driven where the atmospheric temperature is high, or at high altitude, a large amount of fuel vapor is generated so that when the canister is purged, the air-fuel ratio becomes excessively rich. Accordingly, the air-fuel ratio control system operates to dilute the rich mixture in accordance with the feedback signal of the $O_2$-sensor. Namely, a feedback correcting coefficient is set to a minimum value (for example, 0.75), so that the air-fuel ratio is maintained at the stoichiometric air-fuel ratio. Under such a condition, when the throttle valve is closed at idling, the purging is cut off. Accordingly, the air-fuel mixture induced in the cylinders immediately becomes lean. The feedback control system operates to enrich the mixture by increasing the correcting coefficient in response to the output of the $O_2$-sensor. However, as shown in FIGS. 8*b* and 8*c*, because of delay of the feedback control operation, the air-fuel mixture stays lean for some time, which will cause the engine to malfunction.

Japanese Patent Applications Laid Open 58-35256, 59-188063 and 60-175757 disclose systems for preventing the air-fuel mixture from becoming too rich as a result of the purging of the canister. Japanese Patent Applications Laid Open 60-8458 and 61-1857 disclose systems wherein deviation of the air-fuel ratio during the purging of fuel vapor is prevented in dependency on the feedback signal of the $O_2$-sensor. However, none of these disclosures proposes a control system of the air-fuel ratio where the delay of the feedback control is compensated when the purging of the fuel vapor is stopped.

SUMMARY OF THE INVENTION

The object of the present invention is to provide an air-fuel ratio control system which may prevent the air-fuel mixture from temporarily becoming extremely lean when the purging of the fuel vapor is cut-off.

According to the present invention, there is provided an air-fuel ratio control system for an automotive engine, the engine having a canister for purging fuel vapor to an intake passage of the engine, an $O_2$-sensor producing an output voltage relative to oxygen concentration of exhaust gases of the engine, a feedback control system responsive to an output signal of the $O_2$-sensor for controlling the air-fuel ratio of mixture supplied to the engine with a correcting coefficient.

The system comprises detector means for detecting a stop of the purging of the fuel vapor and for producing a purge cut-off signal, and correcting means responsive to the purge cut-off signal for increasing the coefficient, whereby the air-fuel ratio is reduced to enrich the mixture. The correcting means increases the coefficient to 1.0.

The other objects and features of this invention will be apparently understood from the following description with reference to the accompanying drawings.

DETAILED DESCRIPTION OF THE PREFERRED EMBODIMENTS

Figure 1A:
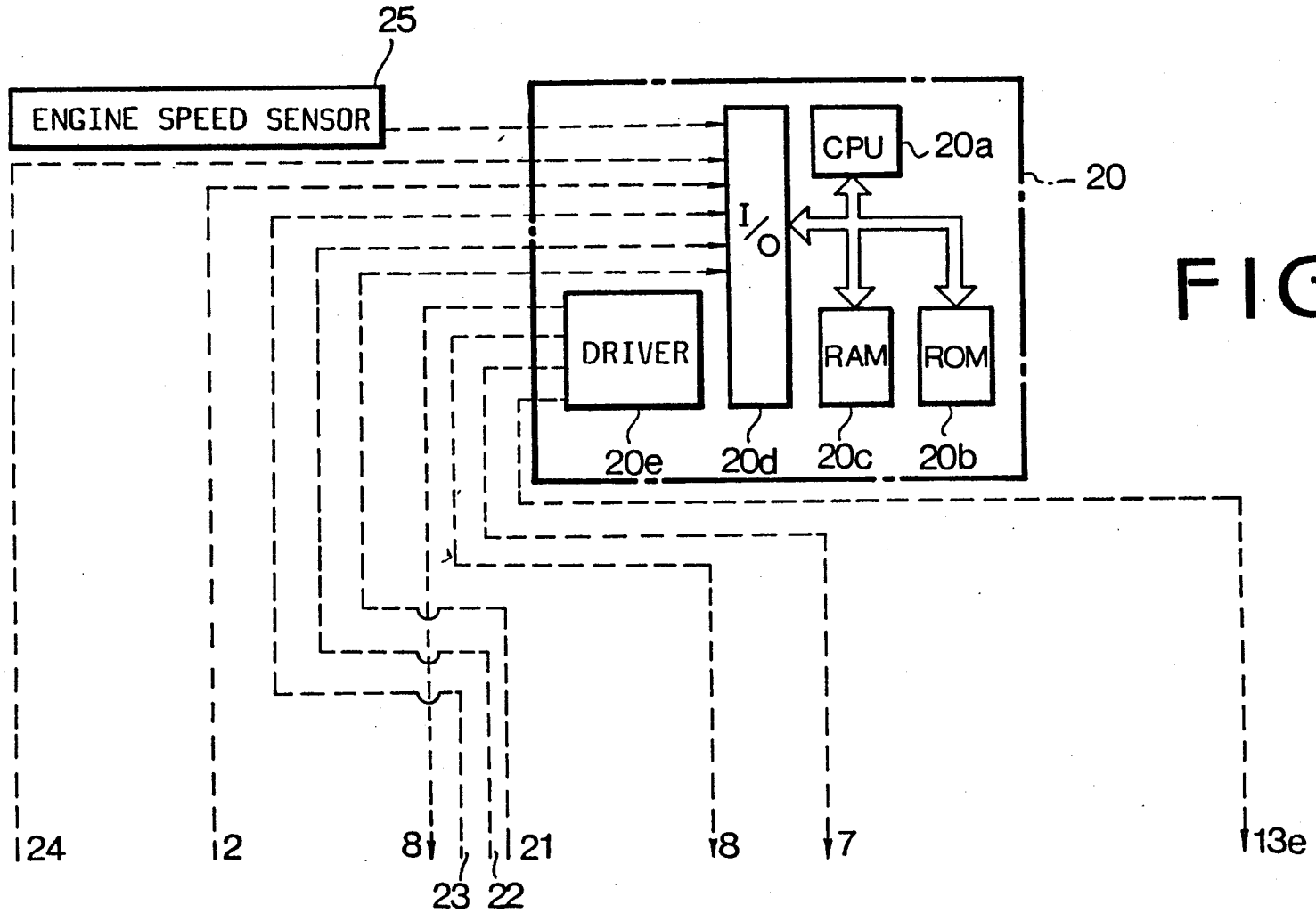
FIGS. 1*a* and 1*b* show a schematic diagram of a system of the present invention.
Figure 1B:
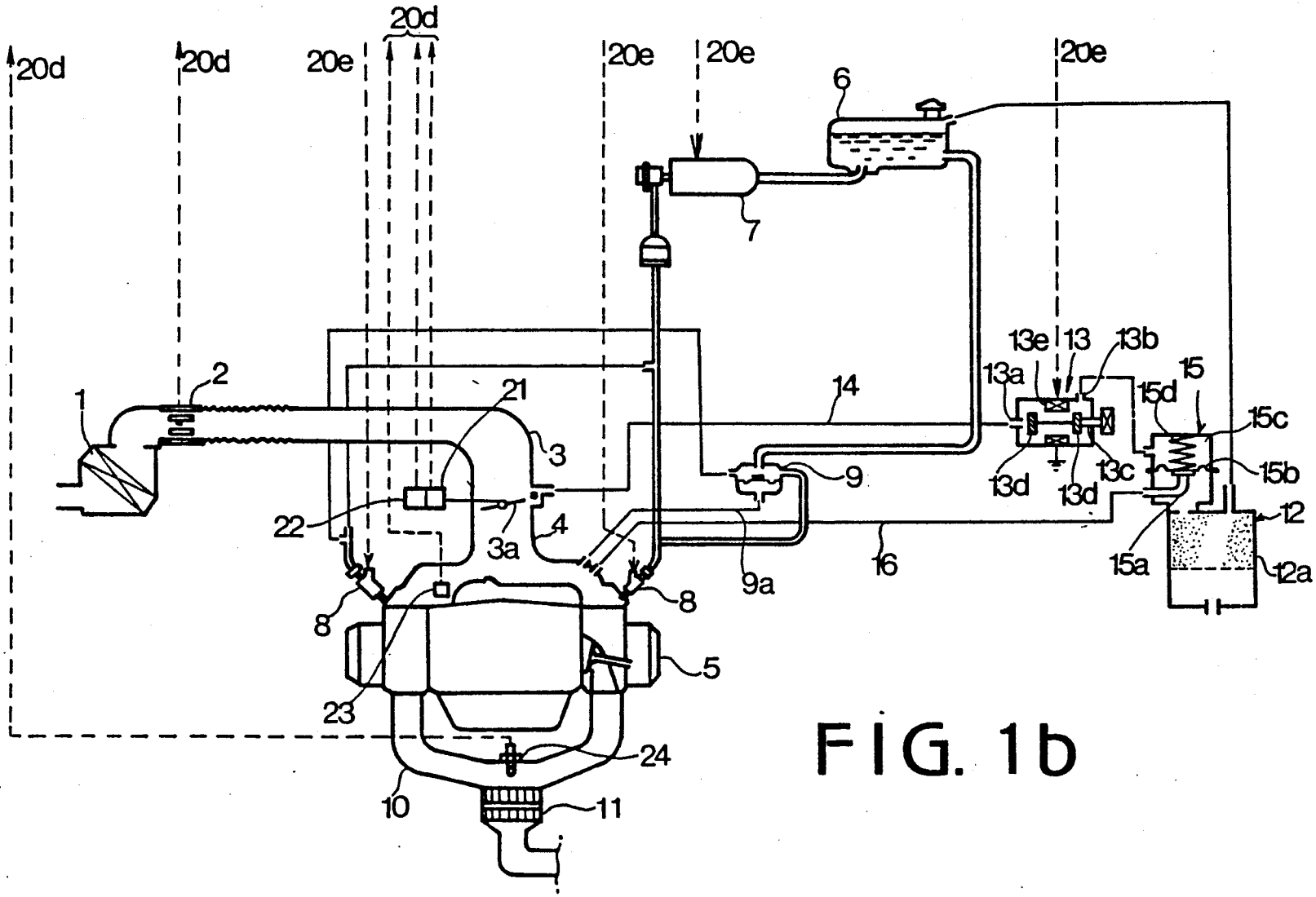

Referring to FIGS. 1*a* and 1*b*, an engine 5 has an intake passage 3, a throttle valve 3*a*, and an intake manifold 4 which is communicated with combustion chambers of the engine. In an intake system, an air cleaner 1 and an air flow meter 2 comprising a hot wire are provided. In an exhaust pipe 10, a catalytic converter 11 and an $O_2$-sensor 24 is provided. Fuel is supplied to fuel injectors 8 from a fuel tank 6 by a fuel pump 7, and returned to the tank 6 through a pressure regulator 9 which is opened by intake manifold pressure applied through a pipe 9*a*. A coolant temperature sensor 23 is mounted in the engine 5 for detecting the temperature of a coolant. A throttle position sensor 21 and an idle switch 22 are attached to the intake passage 3. An engine speed sensor 25 is provided for producing an engine speed signal.

A body 12a of a carbon canister 12 has ports communicated with the fuel tank 6 and a purge valve 15. The purge valve 15 comprises a pipe 15a having an opening at the upper end thereof, a diaphragm 15b defining a vacuum chamber 15c, and a spring 15d urging the diaphragm to the pipe 15a to close the opening. The pipe 15a is communicated through a purge line 16 to the intake manifold 4. The vacuum chamber 15c is communicated with the intake passage 3 through a solenoid-operated control valve 13.

The solenoid-operated control valve 13 comprises a port 13a communicated through a line 14 to the intake passage 3 at a position upstream and downstream of the throttle valve 3a, a port 13b communicated with the vacuum chamber 15c, a pipe 13c communicated with the atmosphere, a valve body 13d axially slidably provided in the housing, and a solenoid 13e. When the solenoid 13e is excited, the valve body 13d is shifted to the right to open the port 13a to communicate the vacuum chamber 15c with the intake passage 3. Accordingly, the diaphragm 15b is lifted by vacuum, thereby opening the pipe 15a. As a result, fuel vapor is purged into the intake manifold 4 through the purge line 16. When the solenoid 13e is de-energized, the port 13a is closed to open the pipe 13c, thereby communicating the vacuum chamber 15c with the atmosphere.

An electronic control system 20 comprises a central processor unit (CPU) 20a, a random access memory (RAM) 20c, a read only memory (ROM) 20b and an input/output (I/O) port 20d. Programs and data for controlling the engine are stored in the ROM 20b.

The I/O port 20d is applied with a coolant temperature signal Tw from the coolant temperature sensor 23, an air-fuel ratio feedback signal λ from the $O_2$-sensor 24, an intake-air quantity signal Qa from the air flow meter 2, an idling signal from the idle switch 22, a throttle valve opening degree signal θ from the throttle position sensor 21, and an engine speed signal Ne from the engine speed sensor 25. These signals are stored in the RAM 20c after processing data in accordance with the program stored in the ROM 20b. The CPU 20a produces respective control signals, which are applied to a driver 20e through the I/O port 20d. The driver 20e produces signals for controlling the fuel injectors 8, fuel pump 7, ignition coils, an EGR (exhaust gas recirculation) system, an idling control actuator and the solenoid-operated control valve 13.

Figure 2:
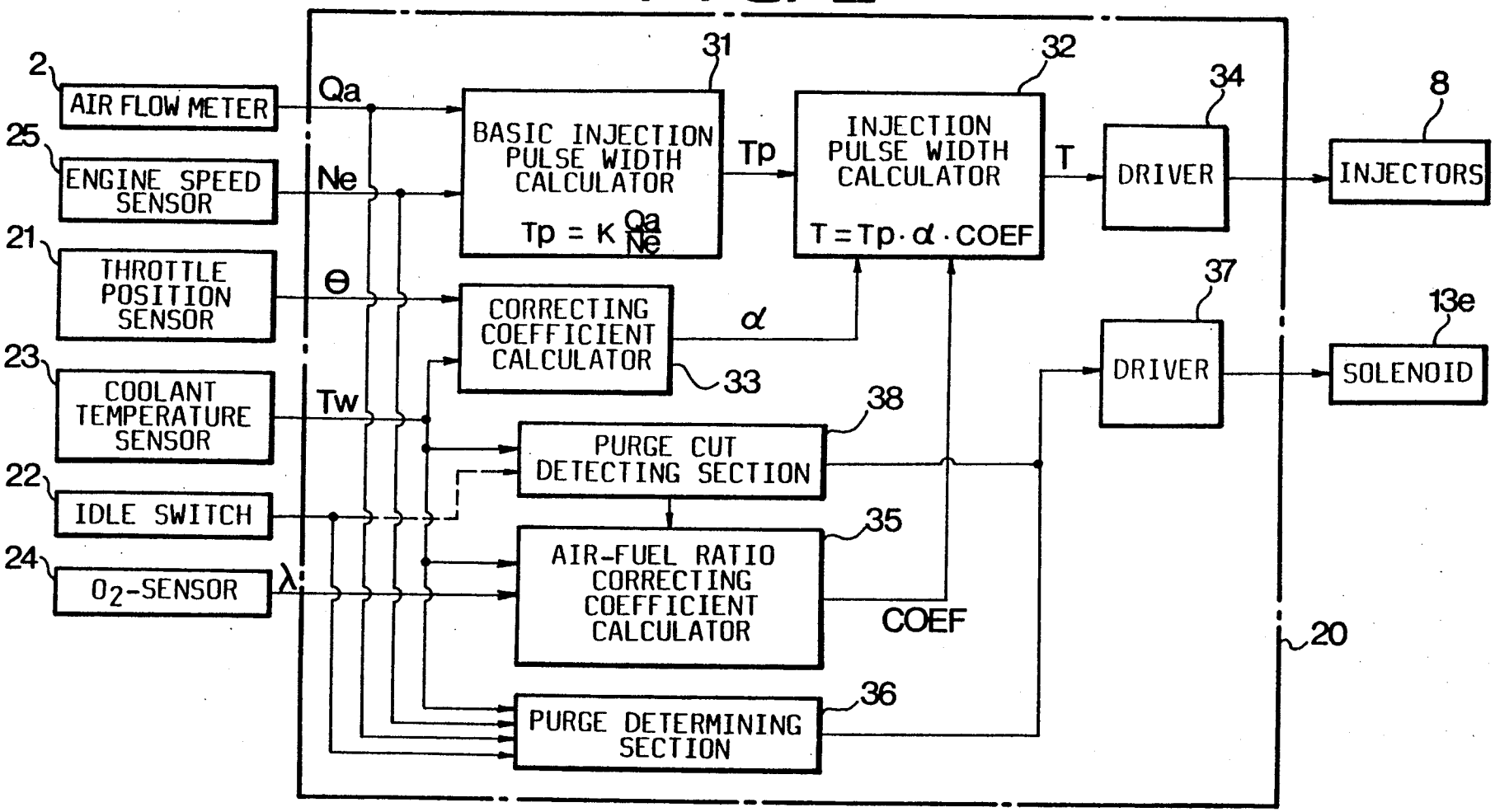
FIG. 2 is a block diagram showing a control unit.

Referring to FIG. 2, showing a system for controlling the air-fuel ratio, intake air quantity Qa and engine speed Ne from the air flow meter 2 and engine speed sensor 25, respectively, are fed to a basic injection pulse width calculator 31. The calculator 31 produces a basic injection pulse width $T_P$ in dependency on the following equation.

$$T_P = K \times Qa/Ne \text{ (K is a constant)}$$

A correcting coefficient calculator 33 is applied with the throttle opening degree θ from the throttle position sensor 21 and the coolant temperature $T_W$ from the coolant temperature sensor 23 to derive a correcting coefficient α from a table for correcting the injection pulse width with respect to acceleration and engine temperature.

The air-fuel feedback signal λ from the $O_2$-sensor 24 is applied to an air-fuel ratio correcting coefficient calculator 35. In the calculator 35, an actual air-fuel ratio dependent on the feedback signal λ and the difference between the actual air-fuel ratio and the stoichiometric air-fuel ratio are calculated to obtain an air-fuel ratio correcting coefficient COEF for correcting the difference.

The basic injection pulse width $T_P$ and the correcting coefficients α and COEF are applied to an injection pulse width calculator 32 to calculate an injection pulse width T in accordance with the following equation.

$$T = T_P \times \alpha \times \text{COEF}$$

The pulse width T is fed to the injectors 8 through a driver 34 to inject the fuel.

The control unit 20 further comprises a purge determining section 36 to which output signals from the air flow meter 2, engine speed sensor 25, coolant temperature sensor 23 and idle switch 22 are fed. Namely, in a stable state after the engine 5 is warmed up, where coolant temperature $T_W$, engine speed Ne and intake air quantity Qa are higher than predetermined values, and the idle switch 22 is turned off, a canister purge signal is applied from the section 36 to the solenoid 13e of the control valve 13 through a driver 37 to energize it. Thus, the fuel vapor is purged from the carbon canister. On the other hand, when the engine 5 is idling, the section 36 produces a purge cut-off signal, so that the solenoid 13e is de-energized to close the valve 15, thereby cutting off the purging.

The purge cut signal is further fed to a purge cut-off detecting section 38 to which the coolant temperature $T_W$ is also applied. When the coolant temperature $T_W$ is higher than a predetermined reference temperature, for example, 90°, the section 38 applies a correction signal to the air-fuel ratio correcting coefficient calculator 35 in response to a purge stop signal (e.g. the purge cut-off signal) so as to compel an increase of the coefficient COEF to 1.0.

Figure 5A:
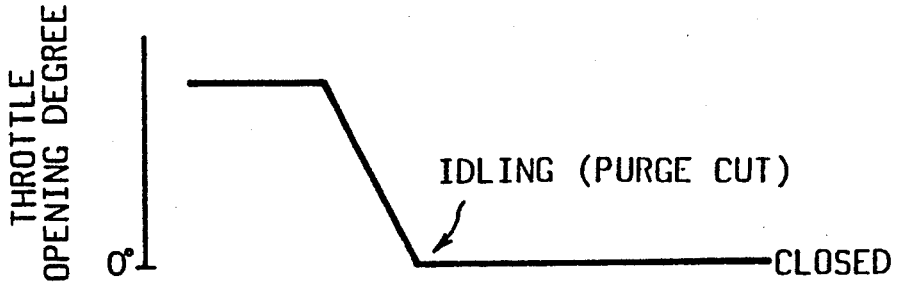
FIGS. 5*a* to 5*c* are graphs explaining the operation of the system of the present invention.
Figure 5B:
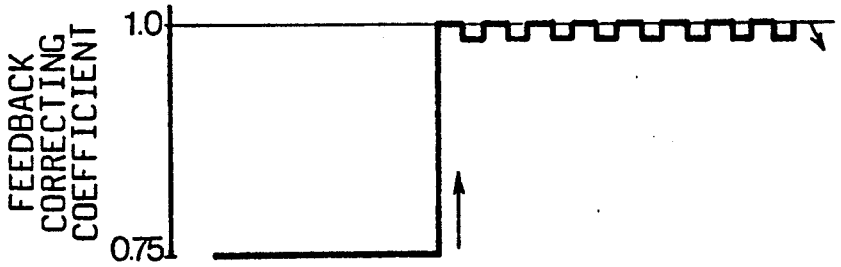
Figure 5C:
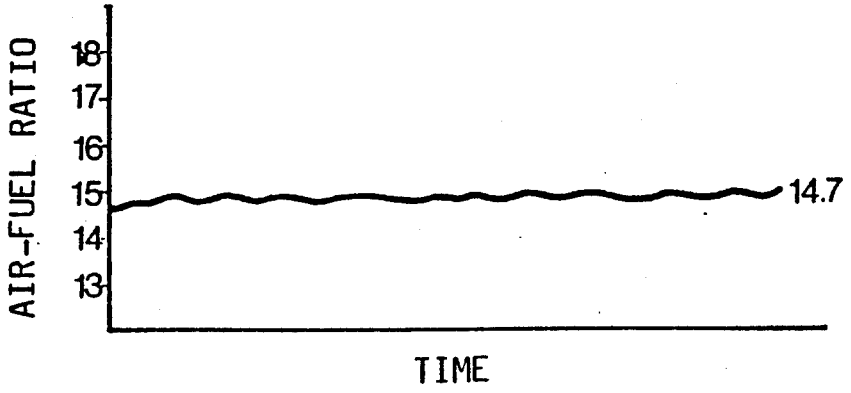
Figure 6:
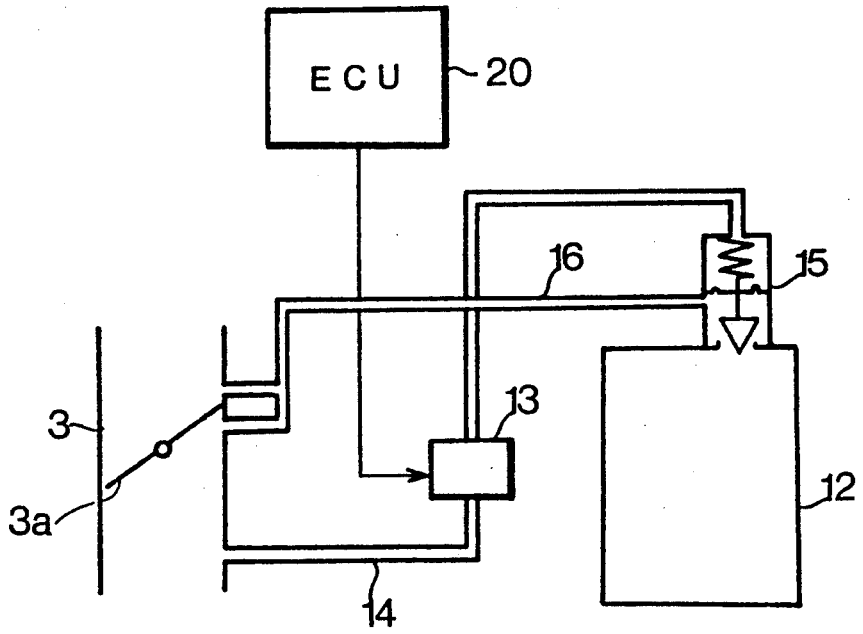
FIGS. 6 and 7 are schematic diagrams of conventional carbon canisters.

The operation of the system for controlling the air-fuel ratio is described hereinafter with reference to FIGS. 5a to 5c.

When the vehicle is driven in a steady state, the canister 12 is purged. Supposing that the correcting coefficient α is 1, when the fuel vapor is purged into the intake system, the vapor is added to the injected fuel. Accordingly, the air-fuel mixture induced into the cylinders of the engine 5 becomes extremely rich. In order to prevent such enrichment, the air-fuel ratio correcting coefficient COEF is obtained in the air-fuel ratio correcting coefficient calculator 35 in accordance with the feedback signal λ. Accordingly, the coefficient COEF, which had been substantially 1.0 before the purge started, is reduced so that the air-fuel mixture becomes lean. When the vehicle is driven in a hot weather where the coolant temperature $T_W$ rises, a large quantity of the fuel vapor is generated. Consequently, the air-fuel ratio correcting coefficient COEF is kept at a minimum value, for example, at 0.75, to reduce the amount of injected fuel. Thus, the air-fuel ratio is kept approximately at the stoichiometric air-fuel ratio.

When the throttle valve is closed to idle the engine 5, for example when the vehicle stops at a traffic light, the solenoid 13e of the control valve 13 is de-energized to cut off the purging. At the same time, the feedback correcting coefficient COEF is set to 1.0 so that the air-fuel ratio is maintained at about the stoichiometric air-fuel ratio 14.7, at shown in FIG. 5c.

Figure 3:
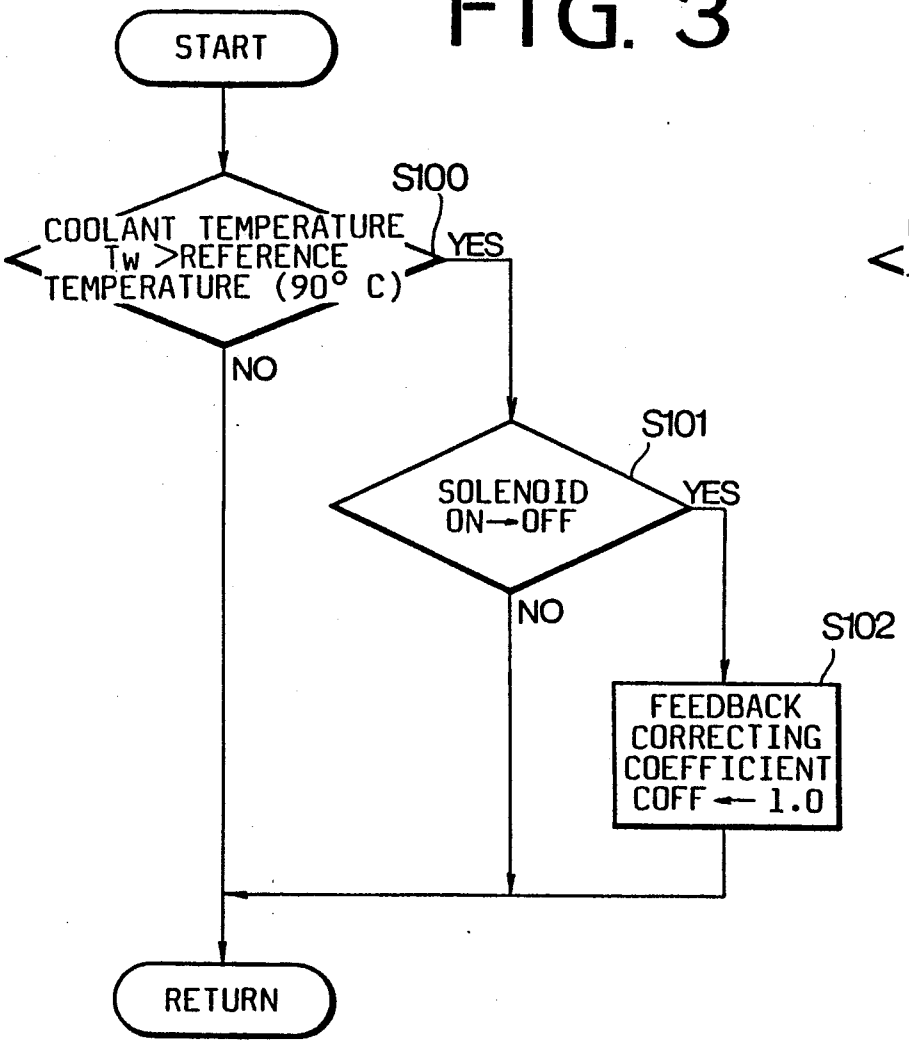
FIG. 3 is a flowchart showing the operation of the system.

Referring to FIG. 3, showing a flowchart of the operation of the present invention, at a step S100, it is determined whether the coolant temperature $T_W$ is higher than the reference temperature such as 90° C. the coolant temperature $T_W$ is higher, the program go to a step S101 where it is determined whether the canister solenoid 13e is energized or not. When the solenoid is de-energized, i.e., the purging of the fuel vapor is stopped, and the air-fuel ratio correcting coefficient COEF is set to 1.0 to keep the air-fuel ratio at stoichiometry. Some time thereafter, the feedback operation is continued.

Figure 4:
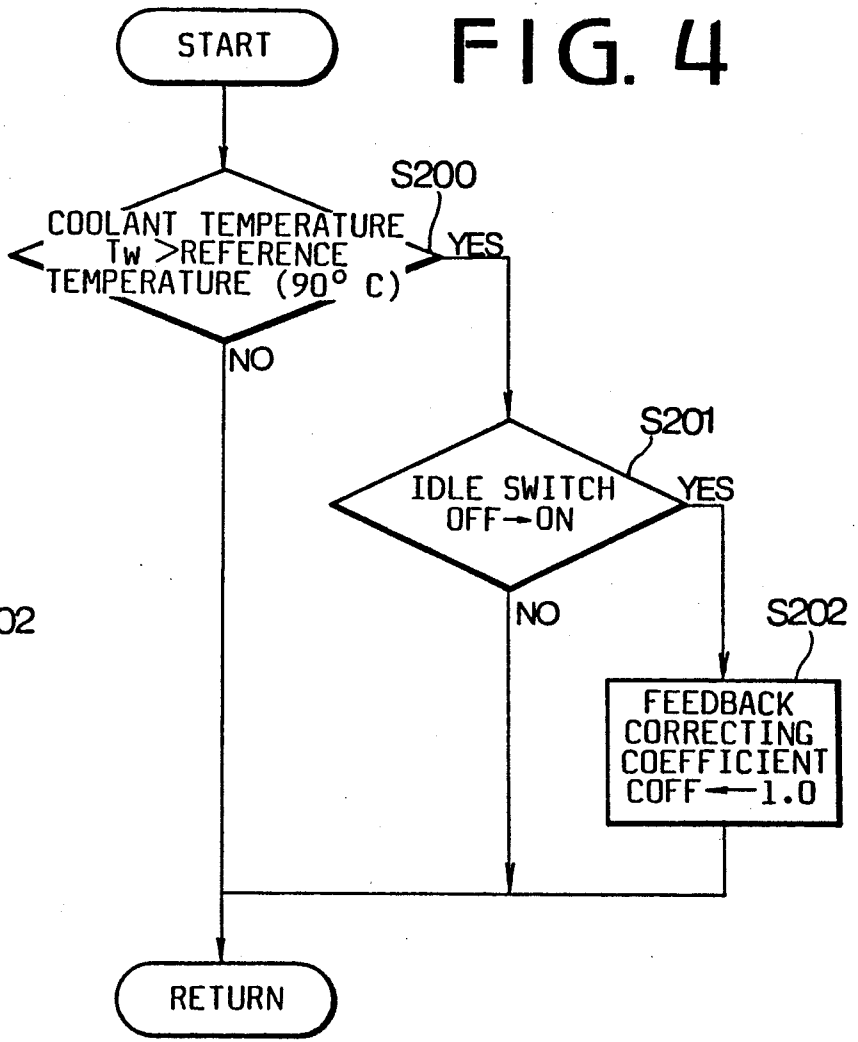
FIG. 4 is a flowchart showing the operation of a second embodiment of the present invention.
Figure 7:
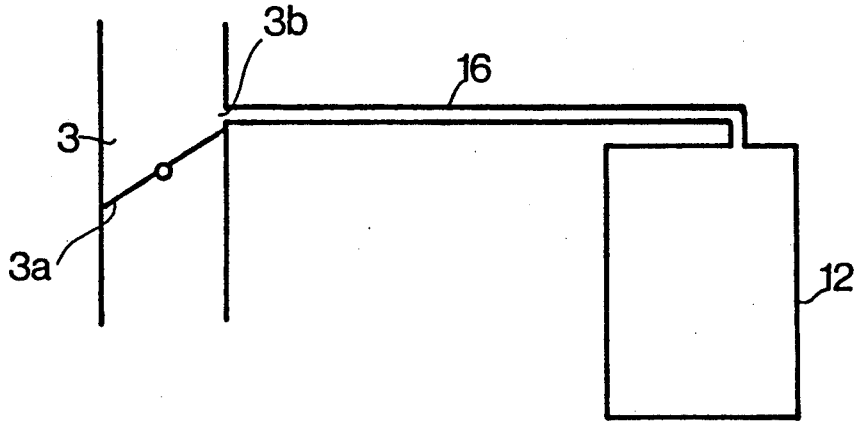
Figure 8A:
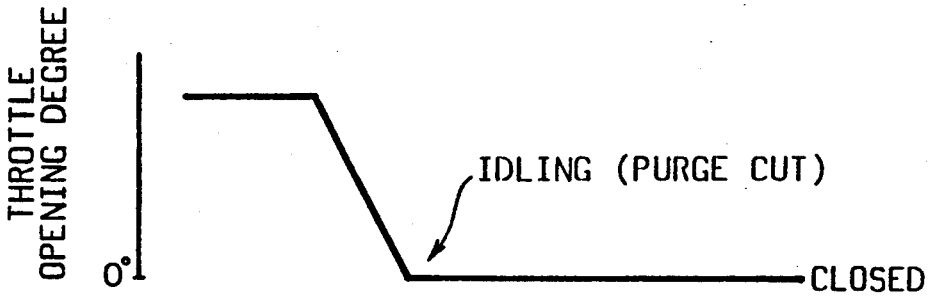
FIGS. 8*a* to 8*c* are graphs explaining the operation of a conventional air-fuel ratio control system.
Figure 8B:
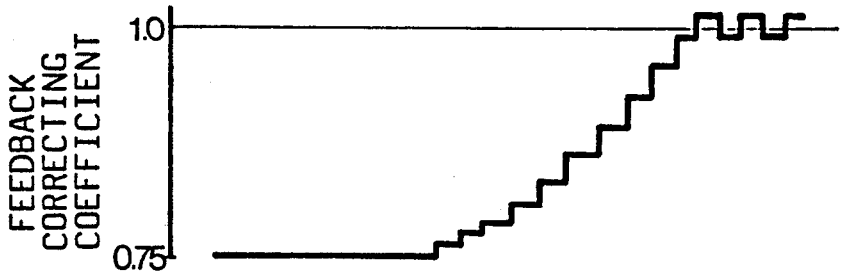
Figure 8C:
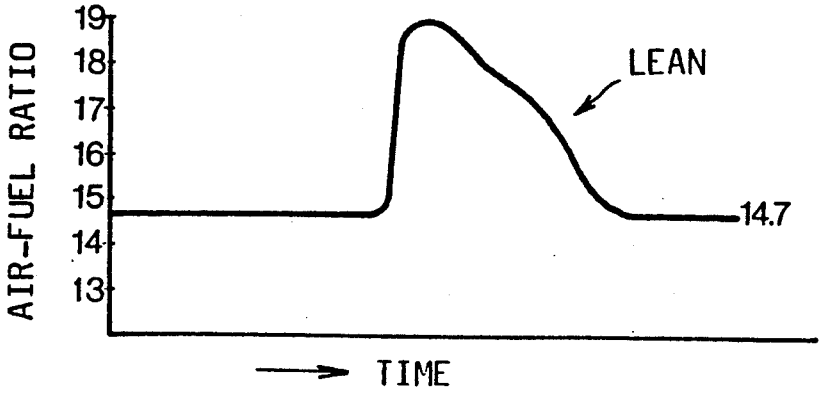

FIG. 4 shows a flowchart of an operation of another embodiment of the present invention when applied to the canister shown in FIG. 7. In the embodiment, as shown by a dotted line in FIG. 2, the output signal of the idle switch 22 is fed to the purge cut detecting section 38. The operation is substantially the same as the flowchart of FIG. 3 except that at a step S201, the cut-off of the purging of the canister is detected in dependency on the operation of the idle switch.

From the foregoing it will be understood that the present invention provides an air-fuel ratio control system where the fuel mixture is enriched when the purging of the fuel vapor is cut-off so as to prevent the engine from malfunctioning.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. An air-fuel ration control system for an automotive engine, said engine having a canister for purging fuel vapor from a fuel tank from the canister to an intake passage of said engine, an $O_2$-sensor for detecting oxygen concentration of exhaust gases of said engine and for producing a corresponding voltage signal, a feedback control system responsive to said voltage signal for producing a coefficient as a function of said voltage signal for controlling air-fuel ratio of air-fuel mixture induced into said intake passage of said engine, and a fuel injection control system for calculating amount of fuel by an equation including said coefficient to inject a proper amount of said fuel in dependency on driving conditions of said engine, the improvement of the air-fuel ratio control system which comprises:

detector means for detecting when the fuel vapor stops purging from said canister to the intake passage and for producing a purge cut-off signal when said detector means detects the stopping of said purging of the fuel vapor; and correcting means responsive to said purge cut-off signal for simultaneously stopping the controlling of the air-fuel ratio via said feedback control system by setting said coefficient to 1.0, thereby preventing said engine from malfunctioning when the fuel vapor stops purging.

2. The air-fuel ratio control system according to claim 1, wherein said detector means comprises an idle switch.

3. The air-fuel ratio control system according to claim 1, further comprising means for providing a coolant temperature signal when the coolant temperature exceeds a reference temperature, and said correcting means is responsive to said coolant temperature signal and to said purge cut-off signal for stopping the controlling of the air-fuel ratio via said feedback control system by setting said coefficient to 1.0.

4. The air-fuel ratio control system according to claim 1, wherein said correcting means restores the controlling of the air-fuel ratio via said feedback control system after a certain time.

5. The air-fuel ratio control system according to claim 1, wherein said detector means comprises an idle switch.

* * * * *